United States Patent [19]

Knox et al.

[11] 4,424,919

[45] Jan. 10, 1984

[54] DISPENSER HAVING PLUNGER LOCKING MEANS

[75] Inventors: Donald E. Knox, New Providence, N.J.; Douglas F. Corsette, Los Angeles; Ronald A. Meyer, San Dimas, both of Calif.

[73] Assignee: Diamond International Corporation, New York, N.Y.

[21] Appl. No.: 315,897

[22] Filed: Oct. 28, 1981

[51] Int. Cl.[3] ..... B67D 5/42; B65D 47/34

[52] U.S. Cl. ..... 222/153; 220/85 P; 222/384

[58] Field of Search ..... 220/85 P; 215/246; 137/316; 222/153, 182, 402.11, 402.13, 384, 402

[56] References Cited

U.S. PATENT DOCUMENTS

| | | | |
|---|---|---|---|
| 3,216,625 | 11/1965 | Corsette . | |
| 3,403,823 | 10/1968 | O'Donnell | 222/153 |
| 3,539,078 | 11/1970 | Venus, Jr. | 222/153 |
| 3,604,596 | 9/1971 | Khoury | 222/153 |
| 3,786,968 | 1/1974 | Ewald . | |
| 3,881,638 | 5/1975 | Grothoff | 222/153 |
| 4,377,106 | 3/1983 | Workman et al. | 222/153 X |
| 4,384,660 | 5/1983 | Palmisano et al. | 222/153 |

FOREIGN PATENT DOCUMENTS

| | | | |
|---|---|---|---|
| 694678 | 9/1964 | Canada | 222/153 |

*Primary Examiner*—David A. Scherbel

*Attorney, Agent, or Firm*—Watson, Cole, Grindle & Watson

[57] ABSTRACT

The reciprocable plunger of a fluid dispenser is immobilized by a frangible strap extending about the plunger and engaging a locking ledge on the container cap. Severance of the strap unlocks the plunger and permits plunger reciprocation.

14 Claims, 3 Drawing Figures

DISPENSER HAVING PLUNGER LOCKING MEANS

BACKGROUND OF THE INVENTION

This invention relates generally to a fluid dispenser having a reciprocable pump plunger, and more particularly to a frangible strap engaging the plunger for preventing its reciprocation during initial periods of non-use.

Plunger lock-down for the class of dispensers to which the invention is directed have included a threaded coupling between the plunger and its cylinder for selectively immobilizing the plunger in its fully depressed condition during shipping and/or storage. Such plunger immobilization is disclosed, for example, by U.S. Pat. No. 3,216,625.

Protective overcaps have also been utilized for this class of dispensers to immobilize plunger reciprocation during periods of non-use. And, U.S. Pat. No. 3,403,823 discloses a tamper-proof actuator cap which comprises an actuator button and a base portion with frangible joining means between the button structure and the base so as to enable separation in response to the application of a downward operating force on the button prior to the dispensing operation.

All of these various approaches taken for immobilizing the plunger are, however, somewhat cumbersome, unrealiable and/or costly, so that a more reliable, less costly, less cumbersome and more appealing approach as taken by the invention is desirable.

SUMMARY OF THE INVENTION

It is therefore an object of the present invention to provide a fluid dispenser having plunger locking means which includes a frangible locking strap extending about the plunger for locking it against reciprocation, cooperating elements on the strap and on the container cap through which the plunger extends defining a snap-fit engagement, and the strap including severing means for unlocking the plunger to permit plunger reciprocation.

Another object of the invention is to provide such a dispenser wherein the strap is substantially U-shaped having a portion overlying an upper end of the plunger and legs extending from such portion, the cooperating elements on the container cap being defined by a collar having a locking ledge, and the cooperating elements on the strap being defined by locking fingers on the legs.

A further object of the present invention is to provide such dispenser wherein the severing means comprises at least one line of weakening along which the strap may be separated, and an outwardly extending pull tab adjacent such line of weakening to facilitate separation.

A still further object of the present invention is to provide such a dispenser wherein the strap legs lie along opposite sides of the plunger, and the cooperating elements are spaced from the legs to facilitate insertion of locking fingers within the cap upon strap assembly. Upon strap separation, the plunger may be withdrawn from its inward and immobilized position, opening a space beneath the head next to the plunger so that the severed legs may be removed, since they are no longer functional and cannot be restored.

Other objects, advantages and novel features of the invention will become more apparent for the following detailed description of the invention when taken in conjunction with the accompanying drawings.

DETAILED DESCRIPTION OF THE INVENTION

Figure 1:
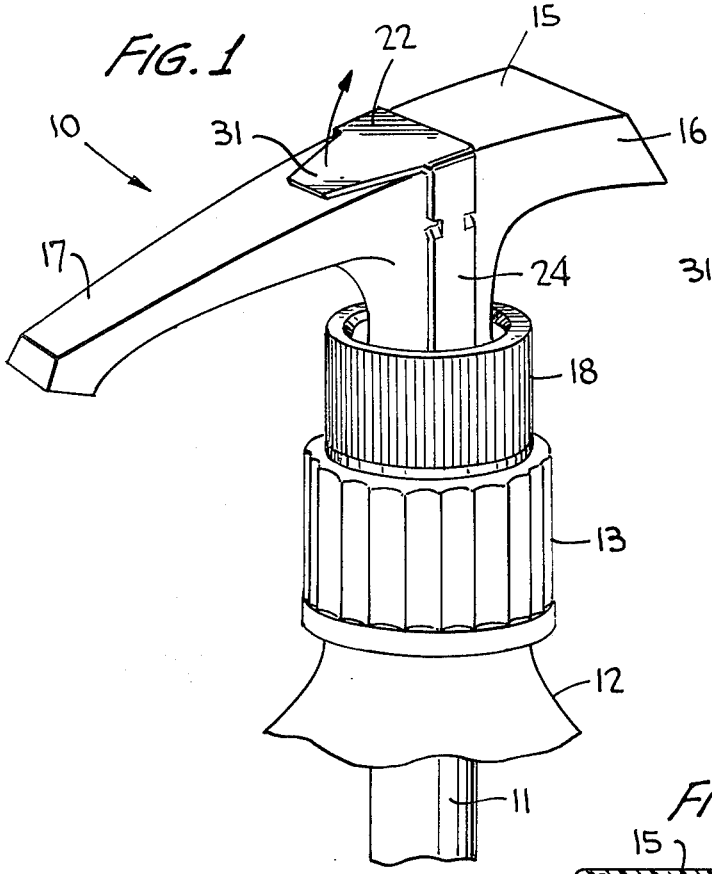
FIG. 1 is a perspective view of the dispenser incorporating the invention.

Turning now to the drawings wherein like reference characters refer to like and corresponding parts throughout the several views, dispenser 10 according to the invention is of the type having its pump cylinder 11 fixedly supported within the container 12 of fluid to be dispensed. A rotatable container cap 13 surrounds the cylinder and mounts the dispenser by threading onto the container neck, as in any normal manner. A hollow pump plunger 14 extends outwardly of the cylinder for actuation by intermittently applied pressure on upper end 15 of its plunger head 16. And, the plunger head includes a discharge spout 17 containing a discharge passage communicating with the hollow plunger for discharging the fluid to be dispensed upon plunger reciprocation, as well known in the art.

A rotatable annular collar 18 extends upwardly of the container cap and is mounted thereon via cooperating locking ledges 19, 21 (FIG. 3) in engagement between the collar and the cap. Other types of acceptable connections between the collar and the cap may be provided.

In accordance with the invention, the pump plunger is immobilized in its fully depressed position during storage and/or shipping or for tamper-proof purposes, by means of a strap 22 of substantially U-shaped formation and of plastic material, for example. As most clearly shown in FIG. 2, the strap includes a flat portion 23 which overlies upper end 15 (FIGS. 1 and 3) of the plunger head, and a pair of legs 24 extending from portion 23 and lying along opposite sides 25 of the plunger. For retaining the strap about the plunger, a pair of grooves (not shown) may be provided along opposite sides 25 for the snap-fit reception of legs 24 which is further facilitated by small tabs 26 struck therefrom. The strap may be otherwise attached to the plunger so long as the attachment is temporary and permits the strap to be completely removed as will become more apparent hereinafter.

The lower ends of legs 24 are bent outwardly or are otherwise provided with locking fingers 27 which are inherently spring biased for cooperation with an annular locking ledge 28 extending inwardly of collar 18. During such engagement between the locking fingers and the locking ledge shown in FIG. 3, the plunger is locked into its fully depressed position. The locking strap may be installed by simply disposing it over the plunger as shown and fully depressing the plunger until the resilient locking fingers slide along and snap into place beneath ledge 28.

Lines 29 of weakening such as creases, shallow slits, perforations or the like, are provided at the junctions between portion 23 and legs 24, and a pull tab 31 extends outwardly of portion 23 and has its opposite edges 32 merged into lines 29.

Figure 2:
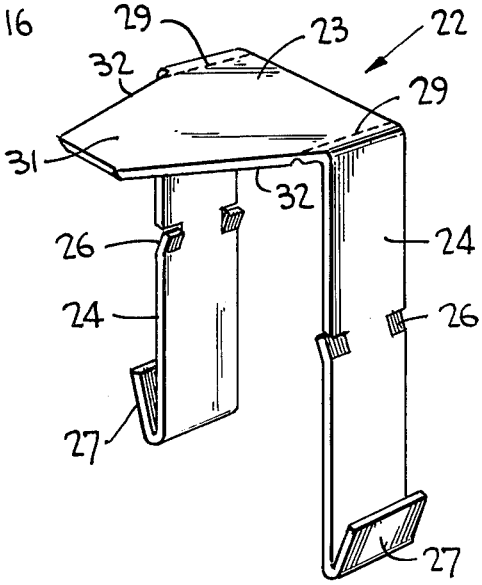
FIG. 2 is a perspective view of the hold-down strap of FIG. 1 shown at a slightly enlarge scale.
Figure 3:
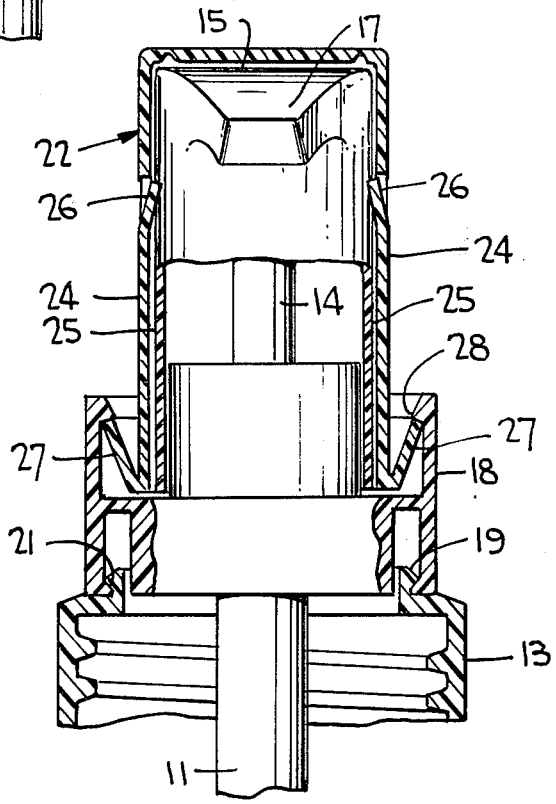
FIG. 3 is a vertical sectional view of the dispenser and strap of FIG. 1.

From the locked plunger position of FIGS. 1 and 3, the dispenser is made ready for a dispensing operation by simply pulling upwardly on tab 31, in the direction of the arrow of FIG. 1, to thereby remove flat portion 23 by tearing along lines 29. Legs 24 with their locking fingers are thus separated from portion 23 to thereby unlock the plunger and permit plunger reciprocation in the known manner. And, the elements cooperating between the strap and the collar, i.e., fingers 27 and ledge 28, are spaced from legs 24 so that, after the legs are separated as aforedescribed, they fall away from the assembly altogether when the plunger is withdrawn from the assembly to place the pump in operation for the first time, since the lower end of the skirt portion of the head rises out of the collar wall, exposing a space underneath between the collar wall and the plunger side wall and removing all support or restraint of the severed legs. The plunger may now be operated as in any normal manner for dispensing product and without any interference by the strap which is now completely removed.

It should also be noted that with the locking strap in place, there is still the capability to rotate the head portion within the collar portion even with the locking strap in place and the plunger restrained against reciprocation. This can be necessary to facilitate rotation of the head to be aligned with the container or carton after being applied to the filled container without disturbing the tamperproof seal—locking strap.

When intact and in place in the assembly, the internal seals are also held in place with the assurance that: the container was sealed at the producer's factory; that no one has actuated the dispenser, thus partially depleting the volume of the contents; that, once broken, the seal/-locking strap cannot be replaced; and that the seal/locking strap, cannot be removed without severing the legs.

From the foregoing, it can be seen that a simple and efficient, yet highly reliable means for immobilizing a reciprocable plunger has been devised which avoid the need for plunger rotation, an overcap, and other types of plunger immobilization means.

Obviously, many modifications and variations of the present invention are made possible in the light of the above teachings. It is therefore to be understood that within the scope of the appended claims the invention may be practiced otherwise than as specifically described.

What is claimed is:

1. In a container mounted dispensing pump of the type in which the pump cylinder is fixedly supported within the container by a container cap surrounding the cylinder, a collar on said cap, a pump plunger projecting outwardly of the cylinder for actuation by intermittently applied pressure on its upper end, said plunger including a discharge outlet above the container, the combination with said pump of means for locking said plunger against reciprocation, said means acting between said plunger and said collar comprising a strap overlying said plunger, means on said collar defining a locking ledge, said strap including means engaging said ledge and having means for severing said strap to thus unlock said plunger and permit plunger reciprocation.

2. A fluid dispensing pump having a rotatable container cap for mounting the pump on the neck of a container of fluid to be dispensed, the pump comprising a reciprocable hollow plunger projecting through said cap and having a discharge outlet through which fluid is expelled upon plunger reciprocation, a frangible locking strap overlying said plunger for locking said plunger against reciprocation, cooperating means on said strap and on said cap defining a snap-fit engagement therebetween, and said strap including strap severing means for unlocking said plunger to permit plunger reciprocation.

3. In a container mounted dispensing pump of the type in which the pump cylinder is fixedly supported within the container by a container cap surrounding the cylinder, a collar on said cap, a pump plunger projecting outwardly of the cylinder for actuation by intermittently applied pressure on its upper end, said plunger including a discharge outlet above the container, the combination with said pump of means for locking said plunger in a fully depressed position against reciprocation, said means acting between said plunger and said collar comprising a separate strap, means on said collar defining a locking ledge, said strap including means engaging said ledge and having means between opposite ends thereof for severing said strap to thus unlock said plunger and permit plunger reciprocation.

4. The combination according to claim 1 or 3, wherein said strap is substantially U-shaped having a portion overlying said upper end of said plunger, and said strap having a pair of legs extending from said portion.

5. The combination according to claim 4, wherein said engaging means comprise locking fingers on said legs.

6. The combination according to claim 5, wherein said legs overlie opposite sides of said plunger, said locking ledge being spaced from said opposite sides of said plunger to facilitate removal of said locking fingers from engagement with said ledge after the severance of said strap and withdrawal of the plunger.

7. The combination according to claim 1 or 3, wherein said severing means comprises at least one line of weakening to facilitate separation of said legs and thus said unlocking of said plunger.

8. The combination according to claim 3, wherein a pull tab extends outwardly of said portion of said strap to facilitate said severing by tearing away said portion from said legs.

9. A fluid dispensing pump having a rotatable container cap for mounting the pump on the neck of a container of fluid to be dispensed, the pump comprising a reciprocable hollow plunger projecting through said cap and having a discharge outlet through which fluid is expelled upon plunger reciprocation, a frangible and separate locking strap extending about said plunger for locking said plunger in a fully depressed position against reciprocation, cooperating means on said strap and on said cap defining a snap-fit engagement therebetween, and said strap including strap severing means located between opposite ends thereof for unlocking said plunger to permit plunger reciprocation.

10. The pump according to claim 2 or 9, wherein said strap is substantially U-shaped having a portion overlying an upper end of said plunger and legs extending from said portion.

11. The pump according to claim 10, wherein said cooperating means on said cap is defined by a collar having a locking ledge, said cooperating means on said strap being defined by locking fingers on said legs.

12. The pump according to claim 9, wherein said severing means comprises at least one line of weakening along which said strap may be separated.

13. The pump according to claim 12, wherein a pull tab extends outwardly of said portion adjacent said line of weakening to facilitate separation by tearing along said line.

14. The pump according to claim 2 or 9, wherein said legs lie along opposite sides of said plunger, said cooperating means being spaced from said legs to facilitate removal of said legs upon severance of said strap and withdrawal of the plunger.

* * * * *